US007980310B2

(12) United States Patent
Stoesz et al.

(10) Patent No.: US 7,980,310 B2
(45) Date of Patent: Jul. 19, 2011

(54) BACKOFF SUB AND METHOD FOR REMOTELY BACKING OFF A TARGET JOINT

(75) Inventors: Carl W. Stoesz, Houston, TX (US); Terry R. Bussear, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 99 days.

(21) Appl. No.: 12/104,185

(22) Filed: Apr. 16, 2008

(65) Prior Publication Data

US 2009/0260822 A1 Oct. 22, 2009

(51) Int. Cl.
*E21B 31/00* (2006.01)

(52) U.S. Cl. ..... 166/301; 166/178; 166/299; 166/63

(58) Field of Classification Search ..... 166/178, 166/301, 377, 286, 340, 242.6, 250.13, 299, 166/63

See application file for complete search history.

(56) References Cited

U.S. PATENT DOCUMENTS 2,250,574 A * 7/1941 Dodge ..... 166/299
2,462,477 A * 2/1949 Edwards ..... 166/242.6
2,670,181 A * 2/1954 Church ..... 166/117.7
2,745,345 A * 5/1956 Sweetman ..... 166/63
3,139,933 A * 7/1964 Golden ..... 173/93
4,007,790 A * 2/1977 Henning ..... 166/299
4,396,065 A * 8/1983 McKenney ..... 166/301
5,220,962 A * 6/1993 Muller et al. ..... 166/369
6,152,222 A * 11/2000 Kyllingstad ..... 166/177.6
7,195,069 B2 * 3/2007 Roberts ..... 166/301
7,395,862 B2 * 7/2008 Ross et al. ..... 166/301
2004/0188086 A1 * 9/2004 McGarian et al. ..... 166/242.6
2008/0142263 A1 * 6/2008 Hall et al. ..... 175/38
2009/0283322 A1 * 11/2009 Dove ..... 175/40

OTHER PUBLICATIONS

Smith Services; "Safety Joints"; Retrieved from the Internet on Jun. 17, 2008; http://www.siismithservices.com/b_products/product_page.asp?ID-560; 2 pages.

Halliburton Auxiliary Services; "Releasable Wireline Cable Head (RWCH)"; 2003; pp. 143-154.

* cited by examiner

*Primary Examiner* — Jennifer H Gay
*Assistant Examiner* — Brad Harcourt
(74) *Attorney, Agent, or Firm* — Cantor Colburn LLP

(57) ABSTRACT

A backoff sub includes a housing and a backoff facilitator at least partially within the housing. The backoff sub is a part of the string that is stuck and is capable of adding energy to the string within which the sub is disposed to facilitate backing off of a portion of that sting close to a stuck point of that string. A method is included.

8 Claims, 3 Drawing Sheets

BACKOFF SUB AND METHOD FOR REMOTELY BACKING OFF A TARGET JOINT

BACKGROUND

In the hydrocarbon recovery industry, tools can and do get stuck in the wellbore during all types of runs, be they drilling, completion, etc. Stuck tools are a source of inefficiency that cost operators significant sums of money in terms of lost days, rig time, lost production, etc. In general, once a stuck is apparent to the operator, a process to determine a depth of what is vernacularly known as the "free point" is undertaken. The free point is that point in the string that is just uphole of the stuck point. The next operation will be to create a jar as close to this point as possible while putting a left handed torque on the string in order to, hopefully, cause the string to unscrew itself right above the stuck point. This, if successfully accomplished, means that all of the string that is free will come out of the well and only leave what is stuck (the fish) behind. Avoiding having a significant amount of a string above the stuck point simplifies the fishing operation that is to follow. Unfortunately, however, this process is unreliable and therefore the art would well receive alternate systems and methods for resolving the shortcomings present in the art.

SUMMARY

A backoff sub includes a housing; and a backoff facilitator at least partially within the housing and capable of adding energy to a system within which the sub is disposable.

A well system includes a string having a plurality of joints at least one of the joints being addressable from a remote location; and one or more backoff subs each disposed at one of the plurality of joints and capable of producing one or more of a jarring action and a backoff torque action.

A method for managing a stuck string in a wellbore includes determining a freepoint of the string; addressing a backoff sub nearest and uphole of the determined freepoint; and activating a backoff facilitator in the backoff sub.

DETAILED DESCRIPTION

Figure 1:
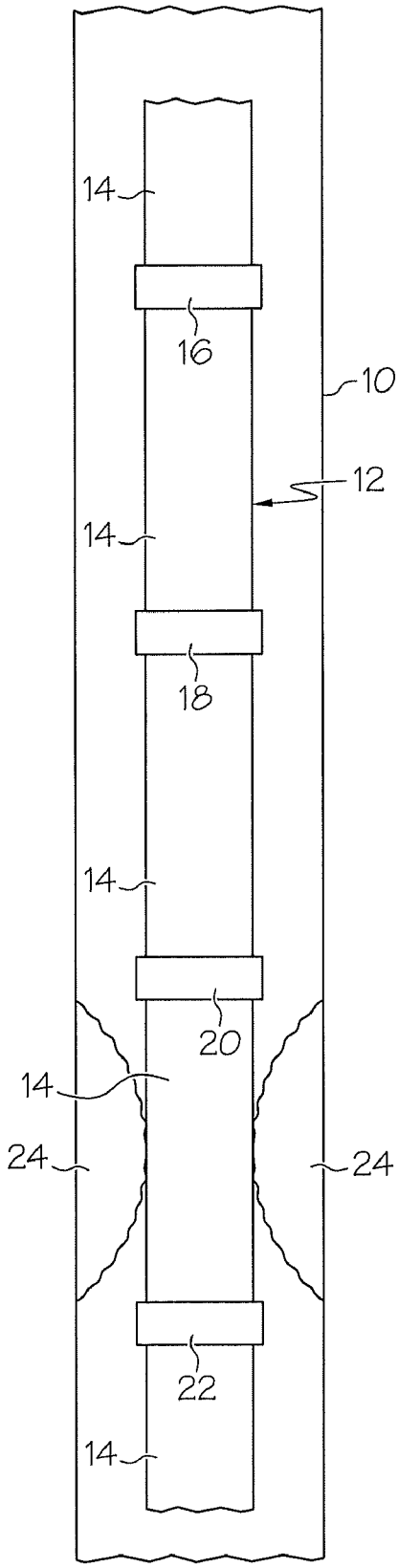
FIG. 1 is a schematic view of a portion of a wellbore with a portion of a string therein.

Referring to FIG. 1, a schematic view of a wellbore 10 with a portion of a string 12 therein is depicted. The string 12 comprises a series of tubular members 14 interconnected together at a number of joints 16-22 numbered individually because they are treated individually in the system disclosed herein. Further illustrated in the drawing is a material buildup 24 to simulate one possible stuck scenario.

Figure 2:
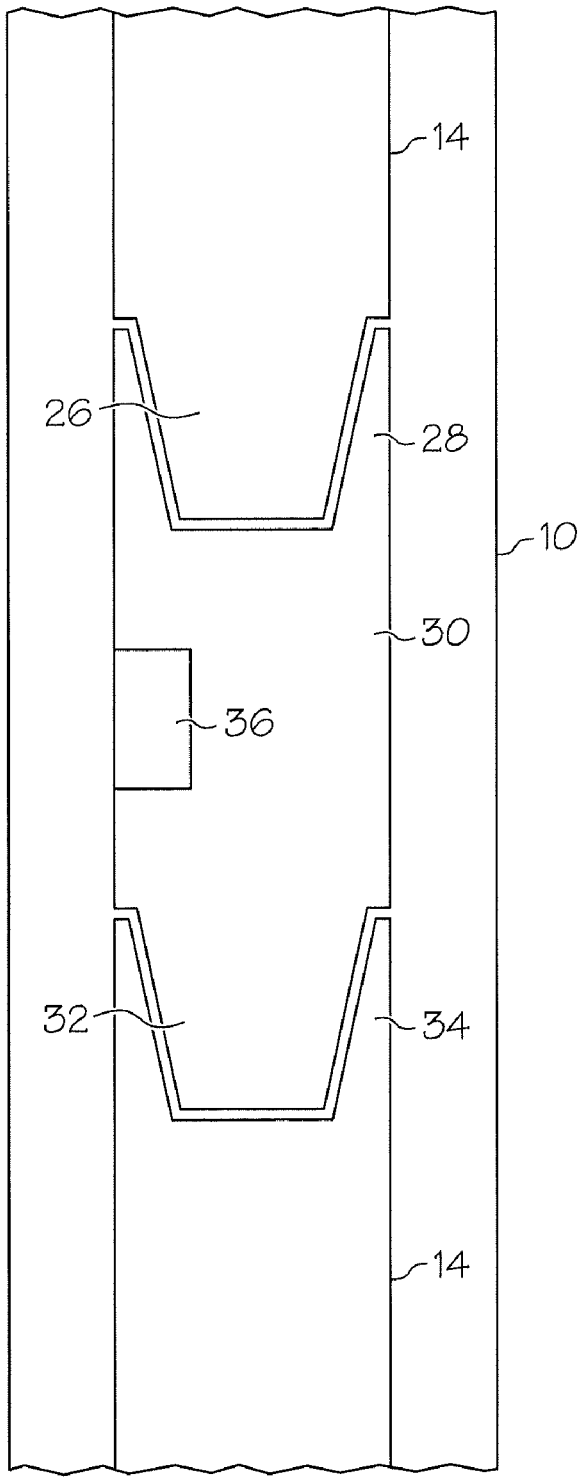
FIG. 2 is a schematic view of a sub having a jar producing energetic configuration.

Each of the interconnections 16-22 is an individually addressable connection configured as a backoff sub having a backoff facilitator disposed at least partially within a housing. The facilitator is such as but not limited to an explosive backoff charge, an acoustic generator, a spark gap tool, a low pressure chamber, a piezoelectric device, a torque producer, etc. The individual sections 14 of the string 12 further include a high bandwidth communications conduit (not shown) that may be provided by, for example, utilizing a wired pipe commercially available from Grant Prideco, Houston Tex., or may be provided by utilizing an umbilical. The high bandwidth communication provided by the conduit allows for addressability at a number of places along the string, and in some embodiments, each joint of the string 12. Therefore, upon determining the location of the stuck point/free point of a string that is experiencing difficulty, a specific addressable backoff facilitator may be activated. This may occur while left hand torque is applied to the string simultaneously from a remote location (e.g. surface) or the backoff facilitator itself may create backoff torque, or both. Where only a jar is to be produced, a charge similar to those commercially available (string shot back off tool from Baker Hughes Inc., for example) for use on wireline or any other the other facilitators noted above might be employed and can be incorporated into the string 12 as its own sub, for example, screwing into the string at each joint. This is schematically illustrated in FIG. 2. If torque is intended to be generated by the configuration, a torque producing sub is employed in one or more joints as illustrated in FIG. 3.

Referring to FIG. 2, a section 14 of the string 12 (see FIG. 1) is illustrated with a pin 26 receivable in a box 28 of a backoff sub 30. The backoff sub 30 includes its own pin 32 receivable in a box 34 of the next adjacent string section 14. One of ordinary skill in the art will immediately recognize that without the backoff sub 30, the connection of pin 26 would be to box 34. Thus the backoff sub 30 is interposed between sections 14 that would traditionally have been screwed together. The back off sub 30 includes a backoff facilitator 36, which may be as noted above. A jar, vibration or torque applied by the action of the facilitator in close proximity of the target joint is very helpful in causing the target joint to back off. FIG. 2 schematically illustrates the facilitator 36 as making up a part of the sub 30. The facilitator may be an explosive charge, piezoelectric stack, vibrator, etc., disposed within a wall of the sub 30 whether enclosed therein or not. Left hand torque will be applied from the surface or other remote location in this embodiment as the jar produced is non-directional. In this embodiment, either of the threaded connections of the backoff sub might be the one backed off with roughly equivalent results relative to the string 12.

Figure 3:
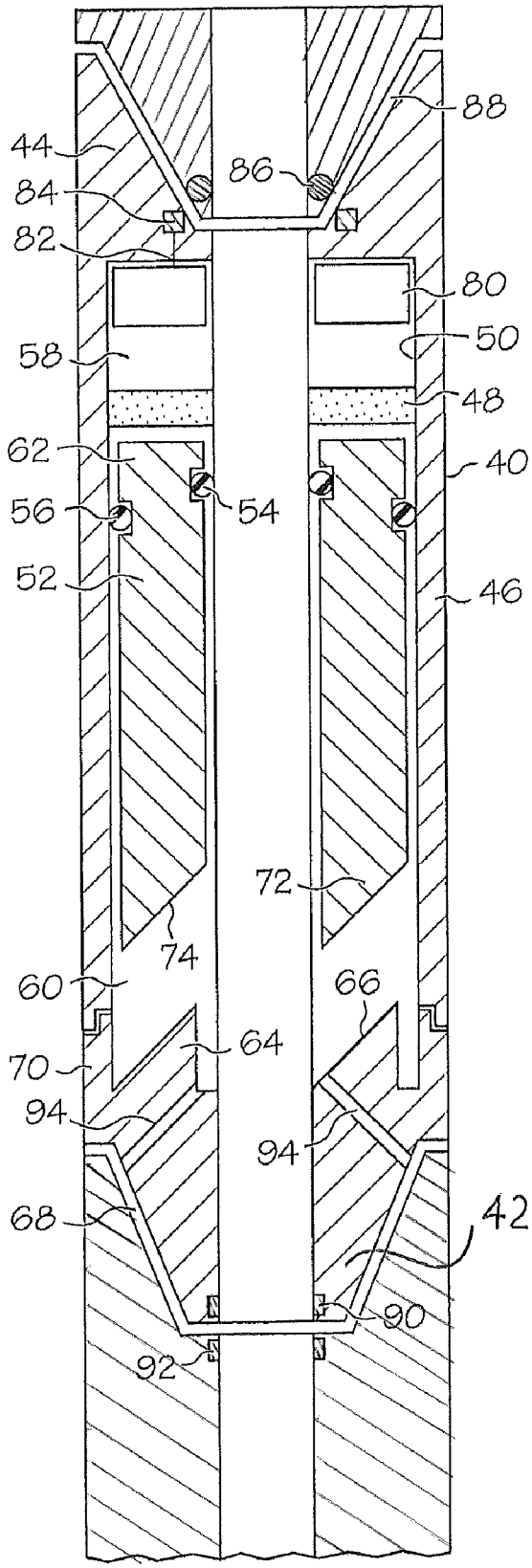
FIG. 3 is a schematic view of a sub configuration that produces a left-handed torque in addition to or independent of a jar.

Referring to FIG. 3, a somewhat more complex embodiment is illustrated in that it does not require but can be used in conjunction with left hand torque from the surface or other remote location. In this embodiment, left hand torque is generated by the application of a mechanical load axially on a configuration that is capable of translating that load to a rotational torque. The backoff facilitator in this embodiment is thus not merely passive relative to the application of torque but is productive of the torque. Referring to FIG. 3, a schematic cross-section view of a torque inducing backoff sub 40 is illustrated. Similar to the foregoing embodiment, the sub 40 includes a pin 42 and a box 44 to enable the interconnection of the sub within a string 12 (see FIG. 1), and at one or more joints (for example, in FIG. 1, numerals 16, 18, 20 and/or 22) thereof. Within a housing 46 of the sub 40 is a series of components that together are capable of producing torque. A linear actuator 48, which may be an explosive charge, is disposed within a cavity 50. In the event that the linear actuator 48 is indeed a pressure-creating configuration, such as the explosive noted, the cavity 50 will also include a compartment 58 that is volumetrically expandable. Also disposed within the cavity 50 is a driving torque mass 52, which in the illustrated embodiment is a piston. The mass 52 is sealed at an inside dimension and at an outside dimension thereof with seals 54 and 56 such as o-rings to inside surfaces of the cavity 50, respectively. Due to the seals maintaining a compartment 58 of cavity 50 fluidly segregated from the remaining chamber 60 of cavity 50, a pressure creating configuration within cavity 50, such as the explosive embodiment of linear actuator 48, is useful to cause the compartment 58 to expand by pressurizing an end 62 of mass 52 and moving it in a direction consistent with enlargement of compartment 58. This will bring mass 52 towards one or more torque drive reaction pins 64. Each torque drive reaction pin 64 presents an angular face 66 that faces a clockwise or right hand direction when the sub 40 is viewed in a transverse cross-section. This is so that when mass 52 is driven into the face 66, a reaction torque is produced in a counterclockwise or left hand direction thereby acting to back off a threaded interface 68. The torque created can be a jarring torque only will little actual rotation at the thread interface or the torque reaction pins 64 can be mounted in a spin collar 70, a rotatable portion of the housing 46, to allow actual rotation 1 movement of the threaded interface. The spin collar 70 rotates in one direction only, that direction being opposite the direction of tightening of the threaded interface so that upon the creation of torque by linear actuation of the backoff facilitator 48, the spin collar 70 allows the unthreading of the threaded interface and thus facilitates the retrieval of the string uphole of the targeted joint.

While the mass 52 may simply be a castellated cut at a torque drive end 72 thereof, in one embodiment, the torque drive end 72 may be configured with one or more angled faces 74 that face a counter clockwise or left have direction so that they will interact with faces 66 during actuation of the sub 40 to help produce the desired torque. Where the faces 74 are provided (as opposed to the castellated embodiment), more torque is generated due to the reduction of frictional losses at the interface between the mass 52 and the reaction pins 64. While the terms "one or more" as used above indicate that a single reaction pin 64 is contemplated and would be operative with the mass 52, more than one reaction pin 64, so that forces may be balanced perimetrically, produces a smoother more effective torque. For example, two pins 64 positioned diametrically opposed to each other (about 180 degrees apart); three pins 64 positioned about 120 degrees apart; four pins 64 positioned about 90 degrees apart; and so on where the included angle is dictated by 360 degrees divided by the number of angles represented will have the balanced result.

In order to activate the actuator 48, one embodiment includes an electronics package 80 disposed operably near the actuator 48 and in one embodiment in the cavity 50, as illustrated. The package is in communication with a wired pipe through such as a conductor 82 connected to an inductive coupling 84 that itself communicates inductively with another inductive coupling 86 across threaded connection 88. Inductive couplings 90 and 92 are provided at an opposite end of the sub 40 to maintain connectivity to other parts of the string. As will be appreciated by one of skill in the art, the sub 40 includes signal interconnection between inductive couplings 84 and 90 although such is not specifically shown.

In a particular iteration of the torque producing embodiment disclosed herein, still referring to FIG. 3, the seals 54 and 56 function not only to hold fluid pressure in compartment 58 but to hold pressure in chamber 60 of cavity 50. In this iteration a fluid within chamber 60 is pressurized when the compartment 58 is expanded. The pressurized fluid is ported through one or more ports 94 to the threaded interface 68 causing that interface to grow slightly volumetrically. This action tends to reduce available friction in the threaded interface thereby making backoff of the joint easier and thus making the sub 40 more effective. Adjusting the level of incompressibility of the fluid in chamber 60 while ensuring that the expansion of compartment 58 can still occur as designed will adjust the amount of volumetric growth in the threaded interface 68.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A backoff sub configured for inclusion in a string, the string having a primary objective other than stuck pipe retrieval comprising:

a housing configured to be connected in series at joints of the string; and a backoff facilitator at least partially within the housing and capable of adding unscrewing energy to the string within which the sub is disposable, wherein the backoff facilitator includes an explosive.

2. The backoff sub as claimed in claim 1 wherein the backoff facilitator is individually addressable.

3. The backoff sub as claimed in claim 1 wherein the housing further comprises a spin collar.

4. The backoff sub as claimed in claim 3 wherein the spin collar is rotatable relative to the housing in one direction only.

5. The backoff sub as claimed in claim 1 wherein the backoff sub includes one or more fluid ports capable of delivering pressurized fluid to a thread interface.

6. A well system comprising:

a string having a plurality of joints at least one of the joints being addressable from a remote location; and one or more backoff subs each comprising a housing configured to be connected in series at joints of the string and a backoff facilitator at least partially within the housing and capable of adding unscrewing energy to the string within which the sub is disposable, wherein the backoff facilitator includes an explosive and each disposed at one of the plurality of joints and capable of producing one or more of a jarring action and a backoff torque action within the same string when that string becomes stuck.

7. A method for managing a stuck string in a wellbore comprising:

determining a freepoint of the string;

addressing a backoff sub comprising a housing configured to be connected in series at joints of the string; and a backoff facilitator at least partially within the housing and capable of adding unscrewing energy to the string within which the sub is disposable, wherein the backoff facilitator includes an explosive, is the backoff sub itself being a part of the same string, nearest and uphole of the determined freepoint; and activating the backoff facilitator in the backoff sub to add unscrewing energy to the string.

8. A backoff sub configured for inclusion in a string, the string having a primary objective other than stuck pipe retrieval comprising:

a housing configured to be connected in series at joints of the string; and a backoff facilitator at least partially within the housing and capable of adding unscrewing energy to the string within which the sub is disposable wherein an explosive charge is disposed within a compartment of the housing that is volumetrically expandable.

* * * * *